United States Patent [19]

Liu et al.

[11] 3,979,624

[45] Sept. 7, 1976

[54] HIGH-EFFICIENCY DISCHARGE LAMP WHICH INCORPORATES A SMALL MOLAR EXCESS OF ALKALI METAL HALIDE AS COMPARED TO SCANDIUM HALIDE

[75] Inventors: Chi-sheng Liu, Monroeville; Chikara Hirayama, Murrysville; Robert J. Zollweg, Monroeville; Ronald A. Madia, Pittsburgh, all of Pa.

[73] Assignee: Westinghouse Electric Corporation, Pittsburgh, Pa.

[22] Filed: Apr. 29, 1975

[21] Appl. No.: 572,809

[52] U.S. Cl. ..... 313/229; 313/184; 313/225

[51] Int. Cl.[2] ..... H01J 61/18

[58] Field of Search ..... 313/229

[56] References Cited

UNITED STATES PATENTS 3,407,327 10/1968 Koury et al. ..... 313/229

FOREIGN PATENTS OR APPLICATIONS 2,362,932 8/1975 Germany

*Primary Examiner*—R. V. Rolinec
*Assistant Examiner*—Darwin R. Hostetter
*Attorney, Agent, or Firm*—W. D. Palmer

[57] ABSTRACT

High-intensity arc-discharge (HID) device of the metal-halide additive type incorporates as essential discharge-sustaining constituents mercury and inert ionizable starting gas and also sodium and/or lithium iodides and/or bromides as well as scandium iodide and/or bromide. The molar ratio of alkali metal halide to scandium halide is from about 1.7:1 to about 5:1 and this greatly enhances the device efficacy for the generation of visible light, which can be enhanced by as much as 32 percent.

8 Claims, 3 Drawing Figures

HIGH-EFFICIENCY DISCHARGE LAMP WHICH INCORPORATES A SMALL MOLAR EXCESS OF ALKALI METAL HALIDE AS COMPARED TO SCANDIUM HALIDE

BACKGROUND OF THE INVENTION

This invention generally relates to discharge devices and, more particularly, to so-called metal halide discharge devices wherein alkali metal halide and scandium halide is used in predetermined proportions and in predetermined amount to enhance the device efficacy.

In U.S. Pat. No. 3,234,421 dated Feb. 8, 1966, is disclosed a so-called metal halide discharge lamp wherein selected metal halides, and particularly those of Group IA, IIA, IIB and IIIA, are incorporated into the device in order to modify the color of the discharge and the operating efficacy of same with respect to the generation of visible light.

In U.S. Pat. No. 3,407,327 dated Oct. 22, 1968, is disclosed a high-pressure discharge device which contains mercury, halogen, scandium and alkali metal. The dosings or loadings of sodium iodide and scandium iodide in the arc tube envelope, when calculated on a gram molecular basis, overlap at their extremes although normally, the grams moles of sodium halide greatly exceed the gram moles of scandium halide as utilized in this device. In the preferred specific example which is recited at column 5, lines 28–32 of this patent, sodium iodide is utilized in amount of 19 milligrams, thorium in amount of 0.5 milligram, and scandium metal, some of which later converts to the iodide, is dosed into the arc tube in amount of 0.5 milligram. The resulting molecular ratio of sodium iodide to scandium is in excess of approximately 11.5:1, which greatly exceeds the molecular ratios desired for these respective materials if best efficacy is to be obtained, as will be explained hereinafter.

In U.S. Pat. No. 3,786,297 dated Jan. 15, 1974, is disclosed still another modification for a metal halide discharge device wherein cerium and cesium halides are utilized with a high mercury loading in order to obtain a very efficient discharge with a relatively low minimum envelope temperature. In the preferred embodiment as disclosed in this patent, alkali metal iodides and rare-earth metal iodides are used in about equal gram-mole proportions. It is also known to use alkali metal halides and rare-earth metal halides including scandium halides and yttrium halides in equal gram-molar proportions.

Many other modified metal-halide HID devices are disclosed in the patent and other literature. These devices generally will display an improved operating efficacy as compared to the standard high-pressure mercury-discharge device as well as improved color, both from the aspect of the appearance of the light source as viewed directly and with respect to the color rendering of objects which are illuminated by the devices.

SUMMARY OF THE INVENTION

An arc-discharge device comprises a sealed elongated light-transmitting arc tube envelope which encloses a predetermined volume with electrical lead-in conductors sealed through the envelope and electrically connected to electrodes which are operatively positioned proximate the envelope ends and spaced apart a predetermined distance within the envelope.

The envelope encloses a discharge-sustaining filling which has the following as essential constituents: mercury in predetermined amount as required to provide a mercury-vapor pressure in the envelope of from 1 to 10 atmospheres as calculated on the basis of an average mercury-vapor temperature of 2000°K; a small charge of inert ionizable starting gas; alkali metal halide of sodium iodide or sodium bromide or lithium iodide or lithium bromide or any mixtures thereof; scandium halide of scandium iodide or scandium bromide or any mixtures thereof, with the molar ratio of alkali metal halide to scandium halide being from about 1.7:1 to about 5:1, and the alkali metal halide plus scandium halide present in the arc tube envelope in amount of at least about 0.1 mg/mm of spacing between the electrodes.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENTS

Figure 1:
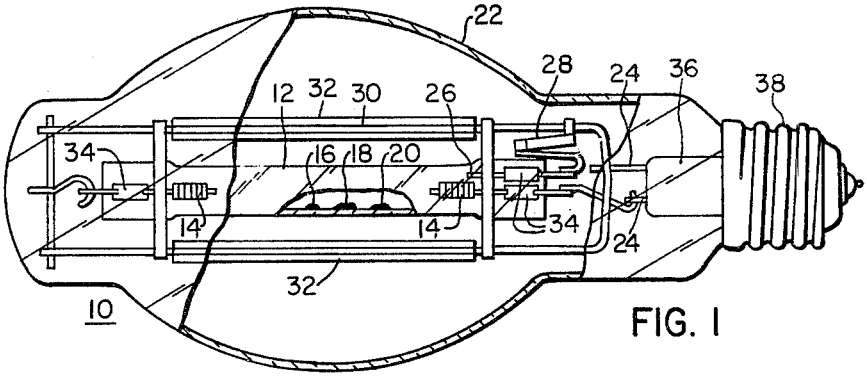
FIG. 1 is a discharge lamp, shown partly in section, which incorporates a quartz inner envelope and a discharge-sustaining filling in accordance with the present invention.

With specific reference to the form of the invention illustrated in the drawings, the discharge device or lamp 10 is generally similar in mechanical construction to the usual high-pressure, mercury-vapor lamp and comprises a radiation-transmitting sealed inner envelope or arc tube 12 having electrodes 14 operatively disposed proximate either end thereof and operable to sustain a vapor discharge therebetween. A charge of mercury 16 and a small charge of inert ionizable starting gas such as 25 torrs of argon are contained within the inner envelope 12. Other noble gases can be substituted for the argon and the gas pressure can be varied.

The charge of mercury 16 is present in predetermined amount as required, when fully vaporized as the sole discharge-sustaining constituent, to provide an operating mercury-vapor pressure of from 1 to 10 atmospheres as calculated on the basis of an average temperature for the vaporized mercury of 2000°K. This average temperature may vary somewhat depending upon the various discharge-sustaining constituents which are used and the lamp operating conditions, but this indicated figure is a representative average temperature for the vaporized mercury. Since the envelope volume is always known, the required amount of mercury to provide the proper operating conditions can readily be calculated. During operation of the device, the other discharge-sustaining materials may interact with the mercury to alter the actual operating pressure of the mercury, and, in addition, the extreme temperature gradient from the center of the arc to the envelope wall may have an effect on the actual pressure within the operating device. For this reason, it is more accurate to express the required amount of mercury as if that material were the sole discharge-sustaining constituent, since the amounts of mercury placed into the arc tube are known and the resulting pressure, as determined by the foregoing mercury vapor temperature, can readily be ascertained.

There is included within the arc tube 12 alkali metal halide 18 of sodium iodide or sodium bromide or lithium iodide or lithium bromide or any mixtures thereof. Also included as a discharge-sustaining substance within the arc tube envelope 12 is scandium halide 20 of scandium iodide or scandium bromide or any mixtures thereof. For reasons as will be explained hereinafter, the molar ratio of total alkali metal halide to total scandium halide is from about 1.7:1 to about 5:1. In addition, the total alkali metal halide plus scandium halide is present in the arc tube envelope in total amount of at least about 0.1 milligram per millimeter of spacing between the arc tube electrodes 14. As a practical matter, the total alkali metal halide plus scandium halide desirably should not exceed about 1.5 mg/mm of spacing between the arc tube electrodes.

In order to conserve heat within the arc tube envelope 12 and to protect same, a radiation-transmitting, sealed outer envelope 22 is spaced from and surrounds the arc tube envelope 12 and the space between the arc tube 12 and the outer envelope 22 can be evacuated or gas filled. Electrical lead-in conductors 24 are sealed through both the inner arc tube 12 and the outer envelope 22 and serve to electrically connect the operating electrodes 14 to a conventional power source.

A starting electrode 26 is also included within the arc tube 12 and connects through a starting resistor 28 to one end of the electrical lead-in conductors 24. The arc tube 12 is maintained in spaced relationship from the outer envelope 22 by means of a conventional supporting frame 30, which frame may be encased with dielectric sleeves 32 formed of quartz tubing in order to minimize the effects of electric fields in the arc tube wall which may cause a loss of the discharge-sustaining constituents. The ribbon conductors 34 serve to facilitate hermetically sealing the lead-in conductors through the ends of the arc tube. The lead-in conductors are sealed through the outer envelope 22 by means of a conventional re-entrant stem press 36 and connect to a standard mogul base 38 to facilitate electrical connection to the power source. As a specific example, the lamp 10 as shown is designed to operate with a power input of 400 watts. Various constructions may be utilized in order to minimize the effects of electric fields on the discharge-sustaining constituents within the arc tube, and particularly the sodium halide. One such construction is disclosed in U.S. Pat. No. 3,780,331 dated Dec. 18, 1973. Another such construction is disclosed in U.S. Pat. No. 3,424,935 dated Jan. 28, 1969.

In the preferred embodiment as shown in FIG. 1 and as will be considered hereinafter, the arc tube envelope 12 is formed of quartz with an inner diameter of 18 mm and the total volume enclosed by the arc tube is 13 cc. The spacing between the ends of the electrodes 14 is 45 mm. The ends of the arc tube 12 may be provided with heat conserving coatings or caps, if desired. A bottom cap is desirably used if the arc tube is to be operated in a vertical orientation.

Figure 2:
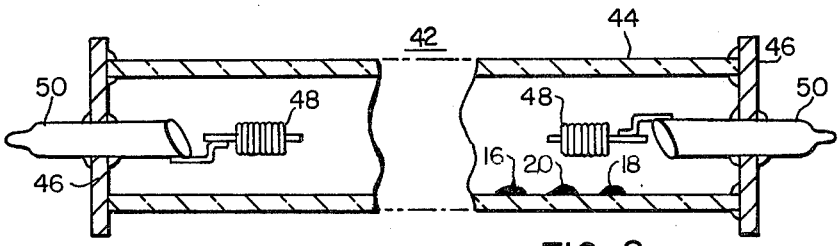
FIG. 2 is a modified form of the discharge device showing only a sectional view of the arc tube envelope which in this embodiment is formed of polycrystalline alumina or similar refractory envelope material and which incorporates a discharge-sustaining filling in accordance with the present invention.

In the alternative embodiment 42, as shown in FIG. 2, the arc tube envelope 44 is a high density sintered polycrystalline alumina body or single crystal alumina body which has alumina end caps 46 sealed thereto. The electrodes 48 are operatively positioned proximate the envelope ends. At the ends of the arc tube 44 there are provided exhaust and fill tubulations 50 which also serve the function of supporting the electrodes 48. In accordance with the present invention, the mercury 16, alkali metal halide 18 and also scandium halide 20 are included within the arc tube 44 in predetermined amount as specified for the previous embodiment, along with the small charge of inert ionizable starting gas. To complete this embodiment as an operative device, the arc tube 44 would normally be supported within an outer envelope, as in the embodiment shown in FIG. 1, and the general mechanical construction of such device is well known.

Figure 3:
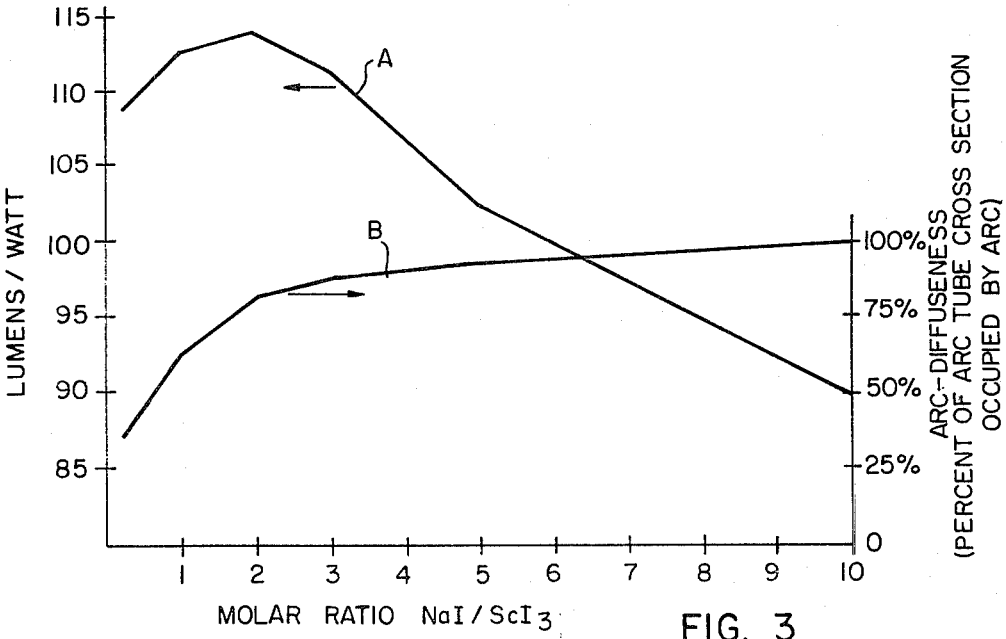
FIG. 3 is a graph of lumens per watt (left ordinate) versus the molar ratio of sodium iodide to scandium iodide, and also shown thereon is a graph of arc diffuseness (right hand ordinate) versus the molar ratio of sodium iodide to scandium iodide.

In FIG. 3 there is shown the effect on efficiency (efficacy) of varying the molar ratio of sodium iodide to scandium iodide, see curve A. In taking this curve, the foregoing specific lamp as shown in FIG. 1, which was designed for operation at 400 watts, had a mercury dosing in the arc tube of 50 milligrams, which provided a corresponding calculated mercury vapor pressure of 3.15 atmospheres, using an average mercury vapor temperature of 2000°K for purposes of calculating the pressure. The starting gas used was argon at a pressure of 25 torrs. By varying the molar ratio of sodium iodide to scandium iodide, as shown on the abscissa of the curve in FIG. 3, and keeping the total dosing of sodium iodide plus scandium iodide at 20 milligrams, an optimum efficacy of about 114 lumens per watt was obtained at a molar ratio of NaI to $ScI_3$ of 2:1.

Superimposed over the efficacy curve A as shown in FIG. 3 is the curve of arc diffuseness versus the molar ratio of sodium iodide to scandium iodide, curve B. In explanation of this curve B, and referring to the right hand ordinate of this figure, the figure 100 percent on the right hand ordinate represents an arc which is sufficiently diffuse so as to substantially fill the arc tube, which for this embodiment had an inner diameter of 18 mm. The ordinate value of 75 percent indicates that the arc is somewhat constricted and appears to occupy only 75 percent of the cross-sectional area of the arc tube. The 50 percent ordinate value represents an arc which appears to occupy 50 percent of the cross-sectional area of the arc tube, etc. For best operation, it is desirable to have an arc which is sufficiently diffuse that it appears to fill substantially the entire cross-sectional area of the arc tube. For purposes of comparison a standard high-pressure mercury arc appears to occupy about 75 percent of the cross-sectional area of the arc tube.

Referring to curve A in FIG. 3, it is seen that best efficacies were obtained when the molar ratios of sodium iodide to scandium iodide were from about 1.5:1 to about 2.5:1. Since a more diffuse arc is obtained at higher molar ratios, however, the more desirable filling actually occurs at a molar ratio of sodium iodide to scandium iodide of from about 2:1 to about 3:1, with an optimum example being a molar ratio of about 2.5:1. When the molar ratio of sodium iodide to scandium iodide is less than about 1.7:1, the arc diffuseness drops rapidly, with the result that there is obtained a somewhat constricted arc. For this reason, even though sodium iodide to scandium iodide molar ratios of less than about 1.7:1 can produce a relatively efficient device, such lower ratios should be avoided. At the other end of curve A, when the molar ratio of sodium iodide to scandium iodide exceeds 5:1, the arc is quite diffuse but the efficacy has dropped considerably. When the molar ratio of sodium iodide to scandium iodide is about 11.5:1, which is representative of the practices of the prior art, the efficacy of the lamp will have decreased to approximately 86 lumens per watt. As shown in FIG. 3, the optimum efficacy is increased over this representative prior art efficacy value by more than 32 percent.

The source color of the lamp shifts only slightly with varying molar ratios of sodium iodide to scandium triiodide as are present in the arc tube of the operating lamp. In the following Table I are the ICI color coordinates for various molar ratios, shown for the same lamps used for taking the curves of FIG. 3.

TABLE I

| Molar Ratios $NaI:ScI_3$ (total dosing 20 mg)[3] | Color Coordinates |
|---|---|
| 1:1 | $\bar{x} = .341, \bar{y} = .394$ |
| 2:1 | $\bar{x} = .351, \bar{y} = .401$ |
| 3:1 | $\bar{x} = .358, \bar{y} = .400$ |
| 5:1 | $\bar{x} = .364, \bar{y} = .393$ |
| 10:1 | $\bar{x} = .348, \bar{y} = .381$ |

The total dosing of sodium halide plus scandium halide will have some effect on the efficacy, although this will vary somewhat with different lamp constructions. For the specific lamp as described in FIG. 1, which has an electrode spacing of 45 mm and is designed to be operated with an input of 400 watts, the total dosing of sodium iodide plus scandium iodide should be at least about 0.1 mg/mm of spacing between the lamp electrodes and as a matter of practicality, desirably should not exceed about 1.5 mg/mm of electrode spacing. For example, if an excess loading or dosing of the halide is used, the melted halide may absorb some of the generated radiations. For this specific lamp, the preferred loading or dosing of the indicated halides is from about 0.3 mg/mm of electrode spacing to about 0.5 mg/mm of electrode spacing to obtain best efficacy. A preferred example of dosing is 0.45 mg/mm of electrode spacing. While the preferred halides are the iodides, equivalent amounts of bromides can be substituted in whole or in part therefor.

The color rendering index (measured by C.I.E. method) of the present lamps is also improved over the color rendering index of similar lamps which used a relatively high molar ratio of sodium halide to scandium halide. As an example, for a lamp in which the molar ratio of sodium halide to scandium halide was 11.5:1, the efficacy was measured at 88 lumens per watt with a color rendering index of 56. As identical lamp wherein the molar ratio of sodium halide to scandium halide was 2.5:1 displayed an efficacy of 118 lumens per watt and a color rendering index of 69. This improvement in color rendering is readily explainable by the spectral energy distributions for the foregoing lamps. In the case of the lamp which operated with an efficacy of 118 lumens per watt, the output comprised a series of emission peaks which were relatively uniform throughout the visible spectrum. In the case of the lamp which operated with an efficacy of 88 lumens per watt, a strong maximum emission peak was measured at about 590 mm and other emission peaks were at most only about 40 percent the intensity of this maximum emission peak.

The apparent explanation for the enhanced efficacy which is obtained when using the relatively low molar ratios of specified sodium halide to the specified scandium halide appears to reside in the fact that sodium halides and scandium halides form a complex molecule. In the case of the iodide, the molecule has the general formulation $NaI.ScI_3$. The vapor pressure of this complex molecule is much greater than the vapor pressure of either sodium iodide or scandium triiodide, so that more of the discharge-sustaining constituents are vaporized, with the attendant improvement in efficacy. In conducted tests, at a temperature of 636°C the measured vapor pressure of the complex molecule $NaScI_4$ was 10 times greater than the measured vapor pressure of $ScI_3$ and 50 times greater than the vapor pressure of NaI. Even though this complex molecule exhibits an extremely high vapor pressure, however, for best operation of the lamp, it is necessary to have some excess of sodium halide (preferably the iodide) to obtain the relatively diffuse arc.

While the foregoing specific examples have considered sodium iodide and scandium iodide, lithium can be substituted for all or a part of the sodium. As a specific example, with a dosing of 10 mg sodium iodide and scandium iodide plus 10 mg lithium iodide and scandium iodide at molar ratios of 2:1, the specific lamp as shown in FIG. 1 was operated at 220 watts, in order to obtain an efficacy of 98 lumens per watt. The discharge was broad and stable with color coordinates of $\bar{x} = 0.331$ and $\bar{y} = 0.389$. Such a relatively low power lamp which operates with good efficacy would appear to have applications for installations which utilize lower power levels to cope with the current energy problem. Another similar lamp wherein the dosing or loading of lithium iodide-scandium iodide was 10 mg plus 5 mg of sodium iodide-scandium iodide displayed an efficacy of 96 lumens per watt when operated with a power input of 300 watts. Yet another lamp dosed with 5 mg of sodium iodide-scandium iodide, 10 mg of lithium iodide and scandium iodide and 7 mg of sodium iodide operated with an efficacy of 105 lumens per watt with a power input of 275 watts.

As a general rule, the lithium iodide-scandium iodide combination tends to constrict the arc somewhat as compared to the sodium-scandium iodides if the lamps are operated at relatively high power inputs. At reduced power input, however, the lamps with lithium iodide operate quite well with an excellent output in the red region of the visible spectrum. A lamp as shown in FIG. 1 dosed with 20 mg of lithium iodide plus scandium iodide (molar ratio 2:1) displayed an efficacy of 90 LPW at a power input of 275 watts. The red color rendition was very good and the source color of the lamp was $\bar{x} = 0.343$ and $\bar{y} = 0.420$. Lithium bromides can be substituted for a part or all of the iodides in the foregoing examples.

As another alternative embodiment, a relatively small amount of cesium iodide can be added to the discharge-sustaining filling in order to broaden the arc and cause it to be more diffuse. As a specific example, the lamp as shown in FIG. 1 can be dosed with 10 milligrams of sodium iodide-scandium iodide having a molar ratio of 2:1, 5 milligrams of lithium iodide-scandium iodide having a molar ratio of 2:1, and 2 milligrams of cesium iodide-scandium iodide having a molar ratio of 2:1. The resulting lamp when operated with a power input of 300 watts will display an efficacy of approximately 103 lumens per watt and a color of $\bar{x} = 0.347$ and $\bar{y} = 0.406$. Small amounts of other discharge-sustaining additives can be utilized with the present alkali metal halide-scandium halide mixtures, examples being thorium bromides or iodides or mixtures thereof, thallium bromides or iodides or mixtures thereof, or indium bromides or iodides or mixtures thereof. These other additives will modify the discharge slightly with respect to efficiency, source color, and the color rendition. As a specific example, 2 milligrams of any of the foregoing other additives can be used to supplement the 20 milligram filling of mixed sodium iodide-scandium iodide as described hereinbefore. Small amounts of other additives can also be used to supplement the discharge-sustaining filling. As an example, for the lamp as shown in FIG. 1 and as described hereinbefore, two milligrams of any of cerium, praesodymium, or neodymium iodides or bromides or mixed iodides-bromides or any of the other lanthanide rare-earth iodides or bromides or mixed iodides-bromides can be added to the discharge-sustaining filling.

We claim:

1. An arc-discharge device comprising a sealed elongated light-transmitting arc tube envelope which encloses a predetermined volume, electrical lead-in conductors sealed through said envelope and electrically connected to electrodes which are operatively positioned proximate the ends of said envelope and spaced apart a predetermined distance within said envelope, and a discharge-sustaining filling enclosed by said envelope and having the following as essential constituents: mercury in predetermined amount as required to provide a mercury-vapor pressure in said envelope of from one to ten atmospheres as calculated on the basis of mercury being fully vaporized as the sole discharge-sustaining constituent with an average mercury vapor temperature of 2000°K; a small charge of inert ionizable starting gas; alkali metal halide of sodium iodide or sodium bromide or lithium iodide or lithium bromide or any mixtures thereof; scandium halide of scandium iodide or scandium bromide or any mixtures thereof, wherein the molar ratio of said alkali metal halide to said scandium halide is from about 1.7:1 to about 5:1; and said alkali metal halide plus said scandium halide is present in said arc tube envelope in total amount of at least about 0.1 mg/mm of spacing between said electrodes.

2. The arc-discharge device as specified in claim 1, wherein said arc-tube envelope is supported within an additional light-transmitting envelope.

3. The arc-discharge device as specified in claim 1, wherein said alkali metal halide is sodium iodide, and said scandium halide is the iodide, and said sodium iodide plus said scandium iodide is present in said arc tube envelope in total amount of from about 0.1 to 1.5 mg/mm of spacing between said electrodes.

4. The arc-discharge device as specified in claim 3, wherein the molar ratio of said sodium iodide to said scandium iodide is from about 2:1 to 3:1.

5. The arc-discharge device as specified in claim 4, wherein the molar ratio of said sodium iodide to said scandium iodide is about 2.5:1.

6. The arc-discharge device as specified in claim 3, wherein said alkali metal iodide plus said scandium iodide is present in said arc tube envelope in amount of from about 0.3 to about 0.5 mg/mm of spacing between said electrodes.

7. The arc-discharge device as specified in claim 6, wherein said alkali metal iodide plus said scandium iodide is present in said arc tube envelope in amount of about 0.45 mg/mm of spacing between said electrodes.

8. The arc-discharge device as specified in claim 1, wherein said discharge-sustaining filling is supplemented by small additional amounts of the bromides or iodides or mixed bromides and iodides of one or more of cesium, thallium, thorium, indium or a rare-earth metal of the lanthanide series.

* * * * *